United States Patent [19]

VanDeripe

[11] Patent Number: 4,524,531

[45] Date of Patent: Jun. 25, 1985

[54] GOLF SHOES

[76] Inventor: Donald R. VanDeripe, 8 Auvergne Dr., Lake Saint Louis, Mo. 63367

[21] Appl. No.: 446,424

[22] Filed: Dec. 2, 1982

[51] Int. Cl.[3] ..... A43C 15/00

[52] U.S. Cl. ..... 36/127; 36/67 A; 36/134

[58] Field of Search ..... 36/127, 59 R, 59 D, 36/134, 32 R, 67 B, 67 A, 107

[56] References Cited

U.S. PATENT DOCUMENTS

| | | | |
|---|---|---|---|
| 1,243,209 | 10/1917 | Park | 36/134 |
| 1,285,426 | 11/1918 | Shaw | 36/107 |
| 1,870,751 | 8/1932 | Reach | 36/127 |
| 2,078,626 | 4/1937 | Bauer | 36/2.5 |
| 2,179,942 | 11/1939 | Lyne | 36/2.5 |
| 2,847,769 | 3/1956 | Schlesinger | 36/127 |
| 2,855,704 | 10/1958 | Schlesinger | 36/127 |
| 2,959,873 | 11/1960 | Schlesinger | 36/127 |
| 2,959,874 | 11/1960 | Schlesinger | 36/127 |
| 3,512,274 | 7/1968 | McGrath | 36/127 |
| 3,609,889 | 10/1971 | Calvin et al. | 36/67 R |
| 4,149,324 | 3/1979 | Lesser et al. | 36/127 |
| 4,161,829 | 7/1979 | Wayser | 36/127 |
| 4,167,071 | 9/1979 | Koransky | 36/127 |
| 4,327,503 | 5/1982 | Johnson | 36/67 A |

*Primary Examiner*—Werner H. Schroeder
*Assistant Examiner*—Mary A. Ellis
*Attorney, Agent, or Firm*—Senniger, Powers, Leavitt and Roedel

[57] ABSTRACT

A pair of golf shoes, the bottom of the sole of each shoe having relatively wide flat beveled surfaces inclined inwardly and downwardly from the inner edge of the sole. These beveled surfaces allow the shoe to roll inwardly about the central longitudinal axis of the shoe when the weight of the person wearing the shoe shifts to the inner side of the foot, as during the address and backstroke stages of the golf swing. The engagement of the beveled surfaces with the ground during the swing provides the golfer with added stability.

9 Claims, 4 Drawing Figures

GOLF SHOES

BACKGROUND OF THE INVENTION

This invention relates generally to golf shoes and, more particularly, to a pair of golf shoes designed to improve the golf swing while maintaining the basic functions of a conventional golf shoe.

The golf swing has been practiced, modified and improved over the years. One of the more important developments has been the so-called "square to square" type swing in which the hip turn is somewhat restricted during the backstroke. This swing places an added stress on the trailing foot, i.e., the right foot of the right-handed golfer, especially on the inner portion of this foot. In order to resist "swaying" and maintain optimum balance, the weight of the golfer must be concentrated on the inner edge of this foot. This weight distribution is achieved by flexing the knee slightly inward and focusing the weight toward the inner edges of the sole and heel of the right shoe for the right-handed golfer.

Although no specific stress is placed on the left foot of a right-handed golfer during the backstroke, a similar distribution of the weight on the inner aspect of the sole and heel of the left shoe is desirable to provide improved body balance in the address position. Moreover, this stance position aids inner flexion of the left knee which provides for a smooth takeaway during the backstroke.

Attempts have been made to improve a golfer's swing by modifying the design of the sole, heel and/or spikes of the golf shoe. Reference may be made in this regard to U.S. Pat. Nos. 2,078,626, 2,179,942, 4,149,324, 4,161,829 and 4,167,071, each of which discloses a modification to a golf shoe for improving the swing of the golfer.

SUMMARY OF THE INVENTION

Among the several objects of this invention may be noted the provision of an improved pair of golf shoes which increases the stability of a golfer during the golf swing; the provision of such shoes which are comfortable to wear; the provision of such a pair of golf shoes which may be used by both left and right-handed golfers; and the provision of such golf shoes which minimize damage to the golf course while improving the golfer's swing.

Each shoe in a pair of golf shoes of this invention comprises a sole and an upper. The sole has a heel section for the bottom of the heel of the foot, an arch section forward of the heel section for the bottom of the arch of the foot, and a front section forward of the arch section for the portion of the foot forward of the arch and for the toes. The shoes have spikes in the bottom of the heel and front sections of the sole. The bottom of the heel and front sections of the sole of each shoe have relatively wide flat beveled surfaces along their inner sides inclined inwardly and downwardly from the inner edge of the sole. When the weight of a person wearing the shoe shifts to the inner side of the foot, as during the address and backstroke stages of the golf swing, the shoe is adapted to roll inwardly about the central longitudinal axis of the shoe to a position in which the beveled surfaces are in engagement with the ground. The golfer is thereby stably supported during the golf swing.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
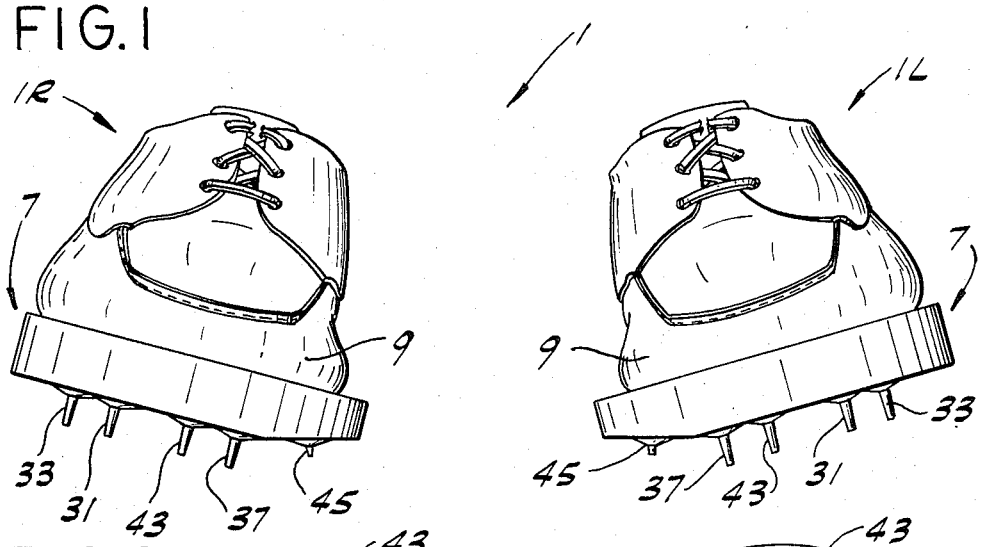
FIG. 1 is a front elevation of a pair of golf shoes in the address position of a golf swing.

Referring to FIG. 1. of the drawings, a pair of golf shoes of this invention is generally indicated at 1, the shoe for the left foot being designated 1L and the shoe for the right foot 1R. The two shoes are symmetric with respect to one another about the central (medial) vertical plane of the body represented by line X in FIG. 2. To facilitate this description, corresponding parts of the shoes will be identified by the same reference numeral.

As shown, each shoe has a sole 7, and an upper 9, the latter of which may be of conventional design and construction. The sole of each shoe has a heel section 11 for the bottom of the heel of the foot, an arch section 13 forward of the heel section for the bottom of the arch of the foot, and a front section 15 forward of the arch section for the portion of the foot forward of the arch and for the toes.

In accordance with this invention, the bottom of the heel and front sections of each sole have relatively wide flat beveled surfaces 17, 19 along their inner (medial) sides inclined downwardly from the inner edge of the sole at an angle in the range of 5–45 degrees from the horizontal, and preferably at an angle of 10–30 degrees (15 degrees being shown in the drawings for purposes of illustration). As viewed from the bottom of the sole (FIG. 2), the beveled surfaces 17,19 of each sole terminates a relatively short distance from the inner edge of the sole, the bevel preferably being along a line 21 extending generally longitudinally with respect to the sole and generally tangent to the inner edge of the arch section 13 at about its narrowest point. The arrangement is such that when the weight of a person wearing the shoe shifts to the inner side of the foot, the shoe will roll inwardly (i.e., pronate) about the central longitudinal axis of the shoe to a position in which the beveled surfaces 17, 19 are in engagement with the ground for stably supporting the person during the address and backstroke stages of a golf swing (see FIG. 1).

For maximum stability, the beveled surfaces 17, 19 should be relatively wide (preferably 20–50 millimeters at their widest point as measured in the plane of the bevel) and should be positioned directly below the inner edges of the feet when they are in their FIG. 1 position. To this end, the inner (medial) edges of the heel and front sections 17, 19 of the sole extend laterally outwardly farther than in conventional golf shoes. Thus in each of the shoes of the present invention the inner edges of the heel and front sections extend laterally outwardly away from the point at which the upper 9 joins the sole 7 a distance of 5–25 millimeters (depending on the angle of bevel and thickness of sole), and preferably about 10 millimeters in order to minimize the possibility of the golf shoe's inner edge hitting the inside of the opposite leg while walking. The soles 7 of the shoes 1L, 1R may be somewhat thicker than in conventional golf shoes.

The heel and front sections 17, 19 of each sole are preferably beveled at about the same angle. The soles of the two shoes should be beveled identically (whatever the angle) in order to ensure that the shoes can properly be used by both left and right-hand golfers.

Figure 2:
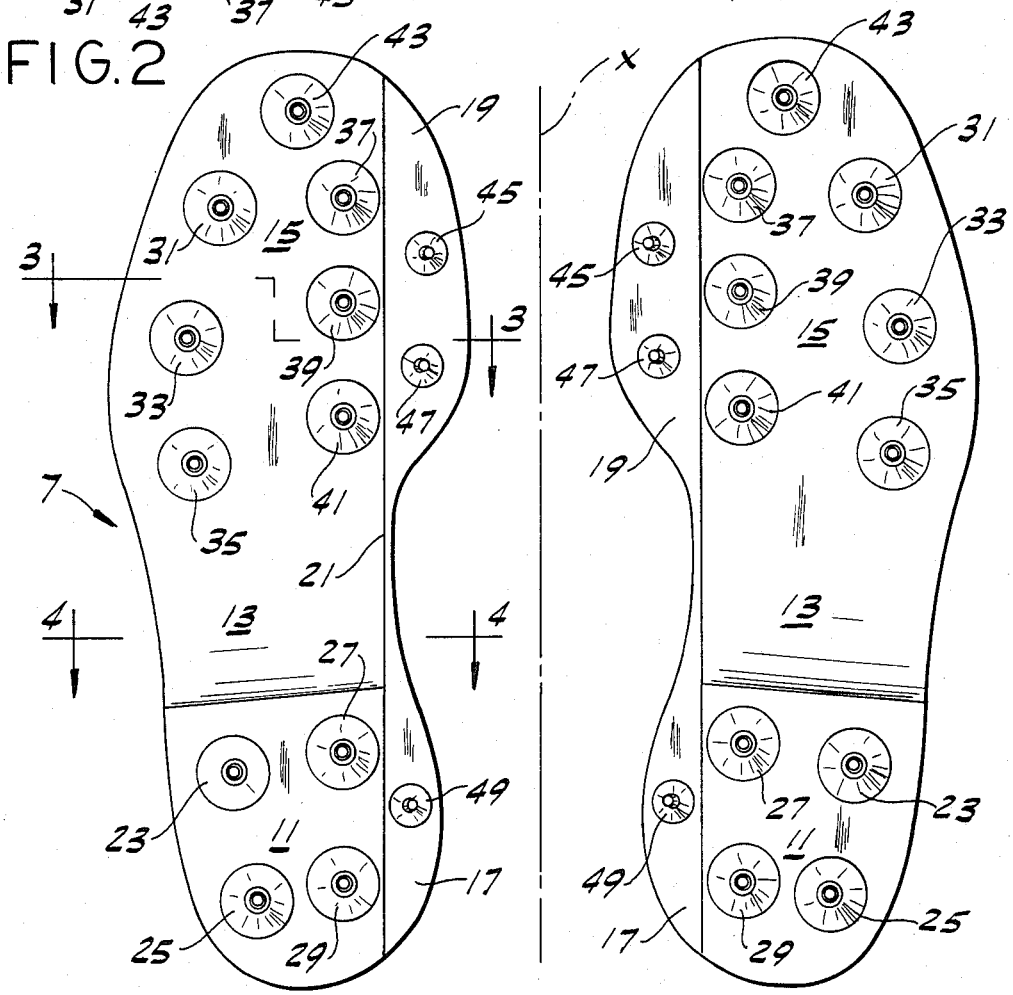
FIG. 2 is a bottom plan view of the soles of the golf shoes of FIG. 1.
Figure 3:
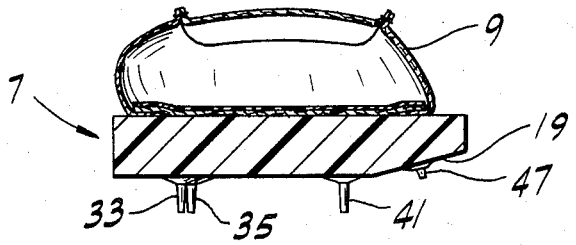
FIGS. 3 and 4 are vertical transverse sections on lines 3—3 and 4—4, respectively, of the right shoe of FIG. 2.
Figure 4:
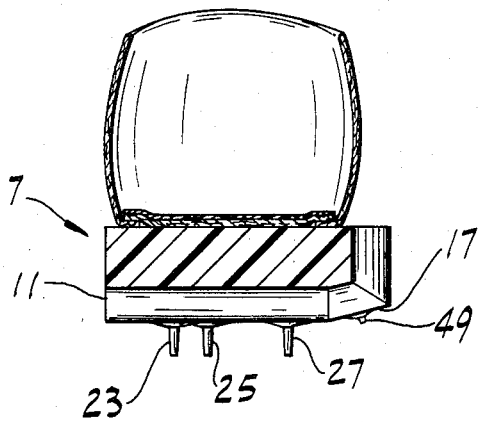

Secured to the bottom of each sole and projecting downwardly therefrom are eleven conventional-size spikes, the heel section 11 having four such spikes designated 23, 25, 27, 29 and the front section having seven spikes designated 31, 33, 35, 37, 39, 41, 43. As illustrated in FIG. 2, the four heel spikes are arranged in two rows of two extending in front-to-back direction with respect to the shoe, with spikes 23 and 25 being toward the outer (lateral) side of the sole and spikes 27 and 29 toward the inner (medial) side closely adjacent but outward of the bevel line 21. Six of the seven front spikes are arranged in two rows of three each extending in front-to-back direction with respect to the shoe, spikes 31, 33, and 35 being disposed toward the outer side of the sole and spikes 37, 39 and 41 being disposed toward the inner side closely adjacent but outward of bevel line 21. The seventh front spike 43, referred to as a toe spike, is located at the forward end of the sole.

Although the flat beveled surfaces 17 and 19 described above will provide stability in the golf swing, a plurality of spikes 45 and 47 may be secured to the beveled surface 19 of the front section of the sole of each shoe and a single spike 49 may be secured to the beveled surface of the heel section 17 of each shoe to provide additional anchoring, traction and stability during the golf swing. These spikes 45, 47 and 49 extend generally perpendicularly from the beveled surfaces and are of smaller dimensions than spikes 23–43 so that they will not project beyond the plane of the bottom of the sole. This prevents undue damage to the terrain of the golf course and especially the fine surface of the putting green. As shown in FIG. 2, the spikes 45 and 47 in the front beveled section 19 are positioned so the forward spike 45 is between spikes 37 and 39 of the inner row of spikes in the front section of the sole, and the rearward spike 47 is between spikes 39 and 41 of the inner row of spikes in the front section 15 of the sole. The spike 49 in the heel beveled section 17 is positioned between spikes 27 and 29 in the heel section 11 of the sole.

The sole configuration shown in the drawings is for purposes of illustration only and different configurations falling within the scope of the above description may also be suitable. It will be understood in this regard that the width of the beveled surfaces 17, 19, the angle at which they are beveled, the thickness of the soles, and the distance which the inner edges of the soles extend laterally outwardly away from the shoes, are interdependent design features which may vary within the stated ranges to arrive at a sole construction which stably supports a golfer when his weight has shifted to the inner edges of his feet.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. A pair of golf shoes, each shoe comprising a sole and an upper, the sole having a heel section for the bottom of the heel of the foot, an arch section forward of the heel section for the bottom of the arch of the foot, and a front section forward of the arch section for the portion of the foot forward of the arch and for the toes, spikes in the bottom of the heel and front sections, the bottom of the heel and front sections having relatively wide flat beveled surfaces along their inner sides inclined inwardly and downwardly from the inner edge of the sole whereby when the weight of a person wearing the shoe shifts to the inner side of the foot, as during the address and backstroke stages of the golf swing, the shoe is adapted to roll inwardly about the central longitudinal axis of the shoe to a position in which said beveled surfaces are in engagement with the ground for stably supporting the golfer during said swing, the sole, as viewed from the bottom of the shoe, being beveled along a line extending generally longitudinally of the sole, said line being generally tangent to the inner edge of the arch section at about its narrowest point.

2. A pair of golf shoes as set forth in claim 1 wherein a row of spikes extends longitudinally with respect to the sole on the front section thereof closely adjacent and outward of said bevel line.

3. A pair of golf shoes as set forth in claim 2 wherein a row of spikes extends longitudinally with respect to the sole on the heel section thereof closely adjacent and outward of said bevel line.

4. A pair of golf shoes as set forth in claim 3 wherein a plurality of spikes are secured to the beveled surface of the front section of the shoe.

5. A pair of golf shoes as set forth in claim 4 wherein said spikes secured to the beveled surface of the front section of the sole are perpendicular to the beveled surface.

6. A pair of golf shoes as set forth in claim 5 wherein said spikes secured to the beveled surface of the front section of the sole are of smaller size than the other spikes in the front section of the sole.

7. A pair of golf shoes as set forth in claim 6 wherein a spike is secured to the beveled surface of the heel section of the sole.

8. A pair of golf shoes as set forth in claim 7 wherein the spike secured to the beveled surface of the heel section of the sole is perpendicular to the beveled surface.

9. A pair of golf shoes as set forth in claim 8 wherein the spike secured to the beveled surface of the heel section of the sole is of smaller dimension than the other spikes in the heel section of the sole.

* * * * *